United States Patent [19]

Takebe

[11] Patent Number: 4,589,780

[45] Date of Patent: May 20, 1986

[54] MEANS FOR GENERATING AN INTERMITTENT ALARM SOUND FOR A TIMEPIECE

[75] Inventor: Katsuhiko Takebe, Tokyo, Japan

[73] Assignee: Rhythm Watch Co., Ltd., Tokyo, Japan

[21] Appl. No.: 787,699

[22] Filed: Oct. 15, 1985

Related U.S. Application Data

[63] Continuation of Ser. No. 439,124, Nov. 4, 1982, abandoned.

[30] Foreign Application Priority Data

Nov. 20, 1981 [JP] Japan ..... 56-172721[U]

[51] Int. Cl.[4] ..... G04B 23/02

[52] U.S. Cl. ..... 368/245; 368/248; 368/250

[58] Field of Search ..... 368/250, 251, 272, 248, 368/245

[56] References Cited

U.S. PATENT DOCUMENTS 4,376,992 3/1983 Aizawa ..... 368/250

FOREIGN PATENT DOCUMENTS 80271 7/1978 Japan ..... 368/245

*Primary Examiner*—Bernard Roskoski

*Attorney, Agent, or Firm*—Koda and Androlia

[57] ABSTRACT

A timepiece of the type including a time indicating circuit and an electronic alarm sound generating means. The alarm sound generating means including a counter outputting a sound switching signal at every predetermined time by counting the pulse signal of the time indicating circuit, a switch-over circuit consisting of a flipflop group for supplying the sounding number switch-over signal to preset the sounding numbers which are performed at a fixed period by the sound switching signal, a preset counter counting for a fixed pulse signal of the time indicating circuit and a value which is determined by the sounding number switch-over signal, a waveform convertor for outputting a preset control signal which presets the preset counter at every fixed period by utilizing the pulse signal from the time indicating circuit, a gate means for outputting the fixed pulse signal together with an audible frequency signal by the time the preset counter is counted up by the fixed pulse signal after the preset counter is preset, and an electronic sounding circuit performing the sounding action of the signal from the gate means, whereby an electronic alarm sound generating means for a timepiece can change its sounding numbers and intervals repeatedly at a fixed period and at a determined time.

5 Claims, 6 Drawing Figures

MEANS FOR GENERATING AN INTERMITTENT ALARM SOUND FOR A TIMEPIECE

This is a continuation of application Ser. No. 439,124 filed Nov. 4, 1982 now abandoned.

BACKGROUND OF THE INVENTION

1. Field of the Invention

The present invention relates to an electronic alarm sound generating means for a timepiece, and more particularly to an electronic alarm sound generating means for a timepiece which performs an intermittent sounding action which can be gradually varied louder one after another than the first sounding action in order to have a better alarming effect.

2. Description of the Prior Art

There have been well-known alarm clocks using an electronic alarming system and they have been of wide and practical use for handy type timepiece.

It is preferable for this type of alarm clocks that a clock starts alarming with smaller effect in the beginning and increases the alarming effect louder as the time proceeds, in other words, the comparatively quiet alarming action is performed in the initial stage, and the louder and firm alarming action is performed after a certain time passes. In order to perform such alarming effect as mentioned above, a sound volume control is generally used. In the recent electronic alarm clocks, however, such system is equipped to simlify the control circuit that an intermittent alarm sounding action is performed with a fixed sound volume but with shorter interval as the time proceeds after the alarm starts in action.

In such prior art device as mentioned above, however, the reduction of the interval into shorter time is performed by thinning out control pulses. Therefore, the reduction is performed at a considerable rate and the clock cannot obtain an alarming effect with smooth variation.

SUMMARY OF THE INVENTION

Accordingly, it is an object of the present invention to provide an electronic alarm sound generating means for a timepiece which can perform an intermittent alarm sounding action not only with a fixed sound volume but also with smooth variation of the interval.

In keeping with the principle of the present invention, the object of the present invention is accomplished with an electronic alarm sound generating means for a timepiece including a counter outputting a sound switching signal at every determined time by utilizing the pulse signal of the time indicating circuit, a switch-over circuit consisting of a flipflop group supplying the sounding number switch-over signal to preset the sounding numbers which are performed at a fixed period by said sound switching signal, a preset counter counting a fixed pulse signal of the time indicating circuit and value of which is determined by said sounding number switch-over signal, a waveform converter outputting a preset control signal which presets said preset counter said sound number switch-over signal from said switch-over circuit at every fixed period by utilizing the pulse signal from the time indicating circuit, a gate means outputting said fixed pulse signal together with the audible frequency signal by the time said preset counter is counted up by said fixed pulse signal after said preset counter is preset, and an electronic sounding circuit performing the sounding action with the basis of the signal from said gate means, whereby an electronic alarm sound generating means for a timepiece can change its sounding numbers and intervals repeated at a fixed period at a determined time.

BRIEF DESCRIPTION OF THE DRAWINGS

The above mentioned features and the object of the present invention will become more apparent from the following description made with reference to the accompanying drawings in which.

DETAILED DESCRIPTION OF THE EMBODIMENT

Figure 1:
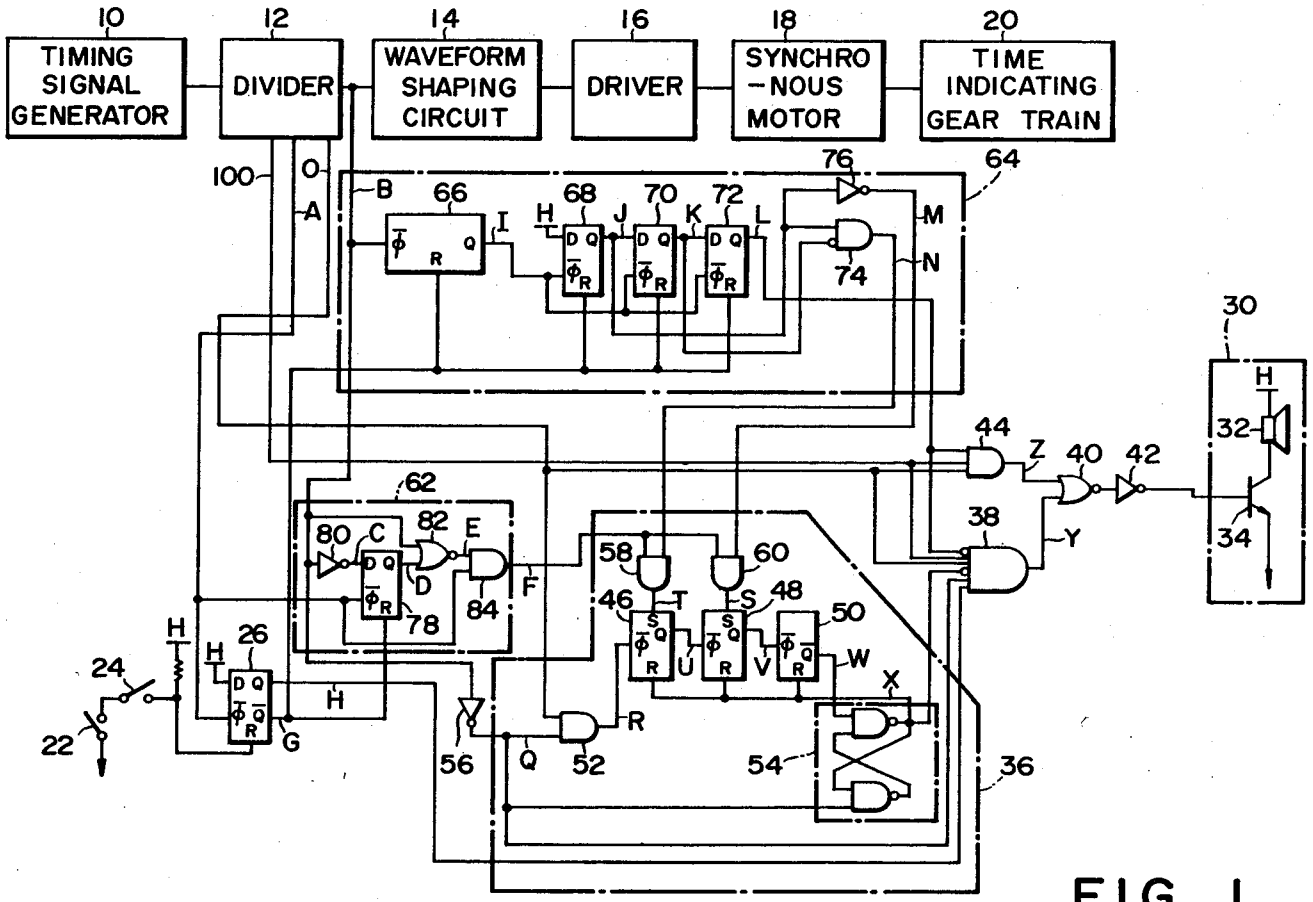
FIG. 1 is a circuit diagram showing a preferable embodiment of an electronic alarm sound generating means for a timepiece in accordance with the teachings of the present invention.

Referring more particularly to the drawings, FIG. 1 shows a preferred embodiment of an electronic alarm sound generating means for a timepiece in accordance with the teachings of the present invention. An electronic alarm clock includes a timing signal generator 10 of a crystal oscillator or the like, a divider 12 which divides the timing signal into the pulse having requesting frequency, a waveform shaping circuit 14 which shapes up the driving pulse of 1 to 2 Hz, a driver 16 including an amplifyer, and a synchronous motor 18 for clock movement, driving force of which is delivered to a gear train 20 the time indicating hands are fixed to. The timepiece is also equipped with an alarm on-off switch 22 and an alarm switch 24 which operate the alarm system. The alarm on-off switch 22 is controlled by manual operation of a user to have the alarm system effective or ineffective, and the alarm switch 24 switches on the alarm system at a requested alarm set time by linking to the time indicating gear train 20 to perform alarming operation. In other words, when both of the switches 22 and 24 mentioned above are put in the on-state at the alarm set time, a flip-flop (FF) 26 for waveform shaping is released from a reset state, and the Q output H of the FF 26 becomes "H" in synchronization with the synchronous signal A from the divider 12 as well as the $\overline{Q}$ output G becomes "L".

As mentioned above, in the present invention, the FF 26 operates at a requested alarm set time and starts the electronic alarm sounding. In this embodiment, the electronic alarm sound is produced by an electronic sounding circuit 30 which consists of a speaker 32 and a transistor 34 supplying the driving current to the speaker 32.

In this present invention, in order to obtain the sounding operation consisting of a plurality of intermittent successive sounds, a preset counter 36 supplies the sounding signal to the above mentioned electronic sounding circuit 30. In other words, this sounding signal is supplied to the transistor 34 of the electronic sounding circuit 30 by way of an AND gate 38, a NOR gate 40 and an inverter 42. In this embodiment, the intermittent sounding action repeated with a fixed period and a successive interval are divided into three stages of 8 seconds per period, and the intermittent sounding numbers for each of the periods are increasingly changed. At the initial stage, the alarming action is performed in a comparatively quiet way, and the louder intermittent sounding action continues after it passes 8 seconds and further after 16 seconds. Furthermore, in this embodiment, an intermittent sounding action having no change in the interval is performed after the three stages of intermittent sounding action until the alarming operation is turned off. In order to produce the intermittent sound without a change in the interval, and AND gate 44 is provided on the one input side of the NOR gate 40 mentioned above.

The above mentioned preset counter 36 includes trigger FF's 46, 48 and 50 which are subordinately connected. The output R of the AND gate 52 is supplied to the clock input of the FF 46 in the initial stage. The Q output U of the FF 46 in the initial stage is supplied to the clock input of the FF 48 in the second stage, and the Q output V of the FF 48 in the second stage is connected to the clock input of the FF 50 in the third stage. The Q output W of the FF 50 in the third stage is supplied to the one input of a bistable multi-vibrator 54, output X of which is inverted and supplied to the above mentioned AND gate 38 as well as to the reset input of each of the FF's 46, 48 and 50. To the one input of the above mentioned AND gate 52 is supplied the fixed pulse signal $\phi$ from the divider 12, and to the other input Q is inverted and supplied the output B of 1 Hz from the divider 12 by way of an inverter 56. At the same time the inverted signal Q of 1 Hz is supplied to the other input of the multi-vibrator 54 and the AND gate 38 mentioned above.

The set inputs T and S are respectively supplied to the inputs of FF's 46 and 48 in the first two stages of the preset counter 36 by way of the AND gates 58 and 60. To each of the one inputs of the AND gates 58 and 60 is respectively supplied the output F of a waveform convertor 62, and to each of the other inputs are respectively connected the outputs N and M of sounding number switch-over circuit in a switch-over circuit 64 which will be described later.

The preset counter 36, therefore, acts a quarternary 1 cycle signal by the three stage trigger FF's 46, 48 and 50 when they all are in the reset state and have no preset signal. When the FF 46 in the first stage is supplied the preset signal T, the preset counter 36 performs the ternary 1 cycle action, and, in the same manner, when the FF 48 in the second stage is supplied the preset signal S, it performs the binary 1 cycle action.

In order to supply the requested preset signal to the preset counter 36 mentioned above at every 8 second period, there is prepared a switch-over circuit 64 which includes a counter 66 determining a switching period, 8 seconds in this embodiment, and three stage FF's 68, 70 and 72 operated by the output of the counter 66, that is, the sound switching signal I. The outputs from the FF group are supplied as the sound number switch-over signal N by way of an AND gate 74 and as the sound number switch-over signal M by way of an inverter 76 to each of the AND gates 58 and 60 in the above mentioned preset counter 36 to output as preset signals T and S to perform the preset action.

The above mentioned counter 66 is already cleared by the Q output G of the FF 26 previously described and to its clock input is supplied the pulse output B of 1 Hz from the divider 12 so that the sound switching signal I is supplied to each of the clock inputs of the FF's 68, 70 and 72 at every 8 second period. Each of the FF's 68, 70 and 72 is already reset by the $\overline{Q}$ output G of the above mentioned FF 26. The Q output J of the FF 68 in the initial stage is supplied to the D input of the FF 70 in the second stage as well as to the AND gate 74 and the inverter 76, and further, the Q output K of the FF 70 in the second stage is supplied to the D input of the FF 72 in the third stage as well as to the other input of the AND gate 74 at the inverted state. Furthermore, the Q output L of the FF 72 in the third stage is supplied to both of the previously described AND gates 38 and 44 at the inverted and direct state so that the electronic alarming sound can be produced in the three stages with different alarming effects and afterwards continued into the intermittent alarm sounding action having no interval.

In order to perform sounding action in the electronic sounding circuit 30, the audible frequency signal 100 is supplied from the divider 12 to each of the inputs of the AND gates 38 and 40, and the tone of the electronic alarm sounding action is determined with the basis of this signal.

The preset control signal F of 1 Hz is utilized in this embodiment to correctly control the three stage sounding number switching action at every 8 seconds in the previously described preset counter 36. In order to obtain this signal F the 1 Hz pulse signal B from the divider 12 is converted its waveform by the waveform convertor 62 including the FF 78 to the reset input of which the $\overline{Q}$ output G is supplied and to clock input of which the pulse output A from the divider 12 is supplied. To the D input of the FF 78 is supplied the pulse output B from the divider 12 as C after the inversion by an inverter 80. Its Q output is supplied to a NOR gate 82 as the signal D together with the above mentioned pulse output B, and further supplied to the one input of an AND gate 84 as the signal E. To the other input of the AND gate 84 is supplied the pulse output A from the divider 12. By this supply of the pulse output A the 1 Hz pulse output B of the divider 12 is converted its waveform and supplied from the AND gate 84 in the waveform convertor 62 to each of the AND gates 58 and 60 in the preset counter 36 as the preset control signal F.

At an alarming time the Q output of the FF 26 is supplied to the AND gate 38 to perform the electronic sounding action, and the alarming operation starts.

The embodiment of this present invention is composed as described hereinabove, and its operation will be described in the following.

Figure 2:
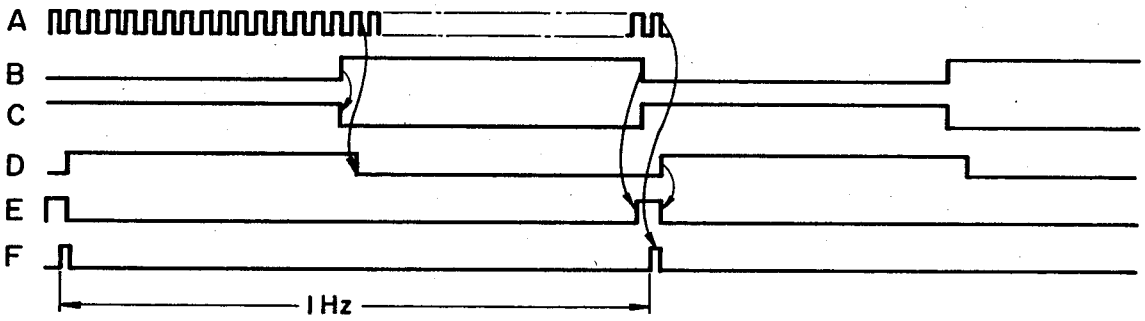
FIGS. 2, 3, 4, 5 and 6 are timing charts describing the operation of FIG. 1.

FIG. 2 shows the operation of the saveform convertor 62. The combination of the pulse outputs A and B from the divider 12 makes it possible to obtain the present control signal F of 1 Hz which is output at slightly later timing than the down turn of the pulse output B.

Figure 3:
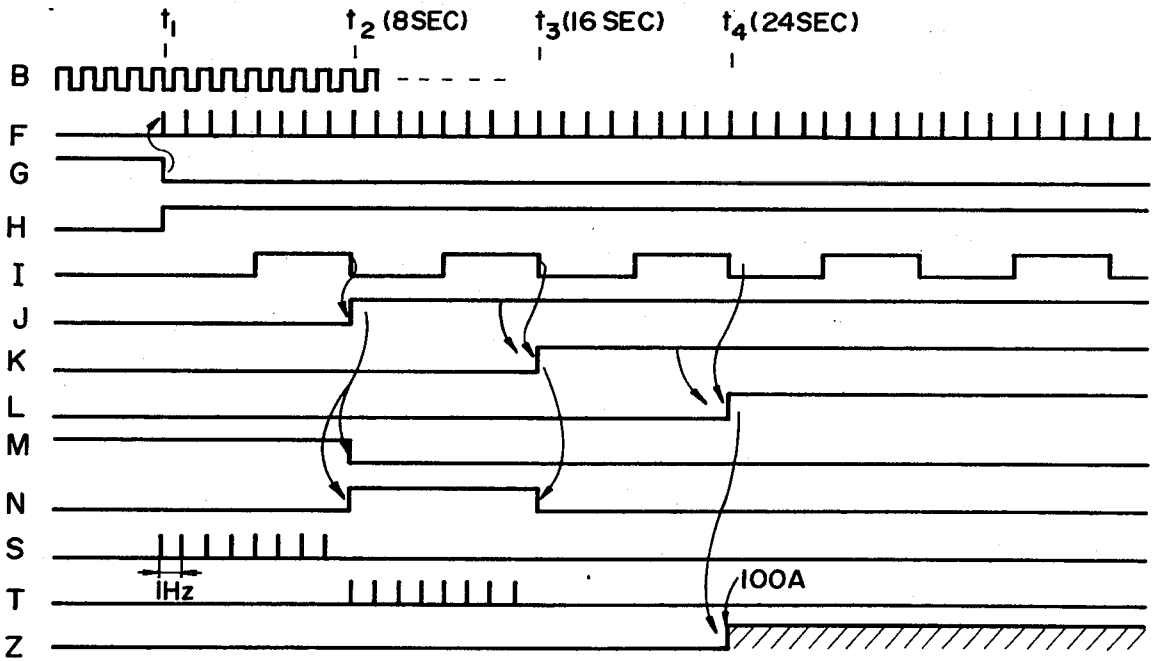

FIG. 3 shows the total operation of the present invention. At the time of $t_1$ the on-operation of the switches 22 and 24 releases the reset state of the Ff 26 so that the AND gate 38 is put in the state capable of gate-on by the Q output H of the FF 26 and the output of the present control signal F is started by the $\overline{Q}$ output G from the convertor 62. In the initial stage between the times $t_1$ and $t_2$ (8 seconds), since the preset signal S is being supplied from the switch-over circuit 64, as previously described, the FF group 46, 48 and 50 in the preset counter 36 becomes the binary 1 cycle counter to perform such sounding action in this embodiment that in a fixed period, that is, for 1 Hz two times of the intermittent sounding actions are performed and the sounding action is not performed for the rest.

In the second stage between the times $t_2$ and $t_3$, the preset counter 36 acts as the ternary 1 cycle counter to perform three times of the intermittent sounding actions in the fixed period, that is, for 1 Hz and to perform no sounding action for the rest.

Furthermore, in the third stage between the times $t_3$ and $t_4$, the preset counter 36 acts as the quarternary 1 cycle counter having no presetting and four times of intermittent sounding and the successive interval determine a fixed period, that is, a period of 1 Hz. Thus, the alarming effect gradually increases.

In this embodiment, the AND gate 44 opens in place of the AND gate 38 after the time $t_4$ and the output is switched over from Y to Z so that the continual sounding action is performed with short intermission. Accordingly, according to the sounding action in this fourth stage, extremely large alarming effect can be obtained.

Figure 4:
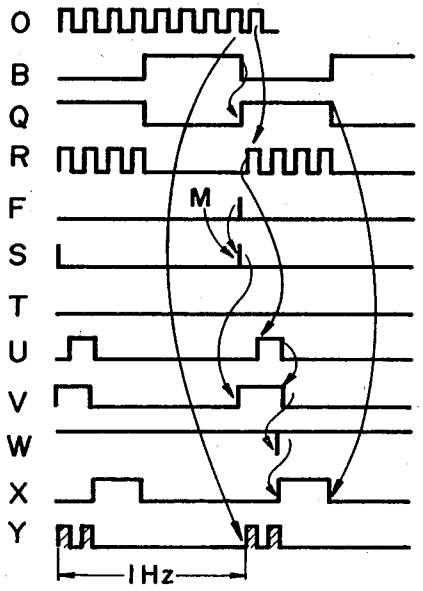

FIG. 4 shows the sounding action in the initial stage of the times between $t_1$ and $t_2$ in FIG. 3. The combination of the output 0 from the divider 12 with the pulse B of 1 Hz forms the interval at least in the last half of the sounding action which is repeated in the fixed periods of 1 Hz. The sounding action in the first half is determined by both of the output X from the preset counter 36 and the output 0 from the divider 12, and, in this embodiment, the sounding numbers are decided by two to four times. In the initial stage in FIG. 4, the preset signal S is output from the switch-over circuit 64 and two times of sounding actions are performed in the first half of the fixed period of 1 Hz (Y) and the rest forms the interval, since the preset counter 36 becomes the binary 1 cycle counter as previously described. The sounding action is performed comparatively quiet in this stage.

Figure 5:
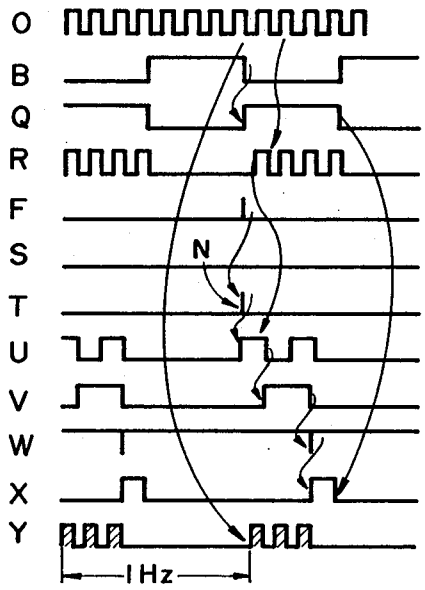

FIG. 5 shows the sounding action in the second stage between the times $t_2$ and $t_3$ in details. Since in the first half of the fixed period of 1 Hz the preset counter 36 becomes the ternary 1 cycle counter, it is understood that three times of the intermittent soundings are performed in the first half and the rest shows the interval.

Figure 6:
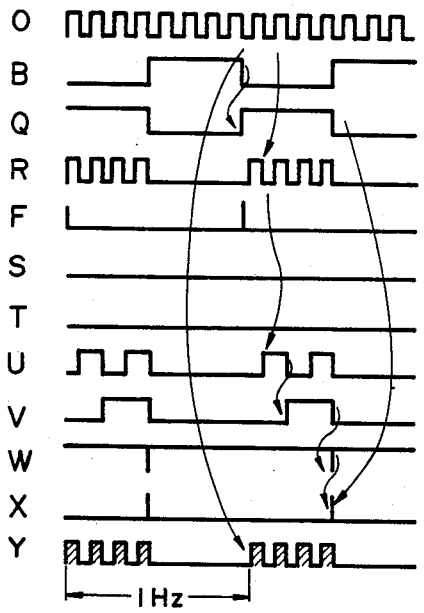

In the same manner FIG. 6 shows the third stage between the times $t_3$ and $t_4$. Since no preset signals T or B is supplied, the preset counter 36 becomes the quarternary 1 cycle counter and all of the first half of the fixed period of 1 Hz is used for the sounding. In this embodiment, four times of the intermittent sounding actions are performed and the the successive last half portion becomes the interval.

As described hereinabove, in this embodiment, the intermittent sounding numbers are changed at every eight seconds after the alarm set time so that the alarming effect can be arranged to be gradually increased.

Incidentally, in this embodiment, the sounding numbers are changed in the three stages but it can be arranged to be optionally changed.

As described heretofore, according to the present invention, the use of the preset counter can produce the smooth intermittent sounding action and provide the sound characteristics of high quality.

I claim:

1. In a timepiece of the type including a time indicating circuit which generates a pulse signal and an electronic alarm sound generating means, said alarm sound generating means comprising:

a switching circuit which consists of a counter for outputting a sound switching signal at every predetermined period by counting the pulse signals supplied from the time indicating circuit and a flip-flop group for counting said sound switching signal and for outputting a coded signal corresponding to the lapse of time from alarm starting;

a preset counter for counting the pulse signals of the time indicating circuit and for being preset to a value which is determined by said coded signals;

a preset control circuit for supplying a preset control signal to said preset counter to enable said coded signal from said switching circuit to be supplied to setting terminals of said preset counter at every fixed intermittent period by utilizing pulse signals from the time indicating circuit;

a gate means for outputting intermittent sound signals together with an audible frequency signal at the time said preset counter is counted up to after said preset counter is preset; and an electronic sounding circuit for performing the sounding action in response to the audible frequency signal from said gate means;

whereby the number of times said sounding action occurs in a fixed intermittent period can be increased along with the lapse of time from the beginning of alarm operation.

2. A timepiece according to claim 1, wherein said time indicating circuit comprises a timing signal generator and a frequency divider coupled to said timing signal generator and said pulse signal is taken from said frequency divider.

3. A timepiece according to claim 2 wherein said electronic sounding circuit comprises a speaker and a transistor amplifier circuit coupled to an output of said gate means for supplying driving current to said speaker.

4. A timepiece according to claim 3, wherein said audible frequency signal is taken from said frequency divider.

5. A timepiece according to claim 4, wherein said gate means comprises at least a NOR gate.

* * * * *